United States Patent [19]

Holtzapple et al.

[11] 4,176,522

[45] Dec. 4, 1979

[54] TORQUE MONITOR

[75] Inventors: Mark T. Holtzapple, 8920 Normandale Blvd., Bloomington, Minn. 55437; Robert L. Wehe, Ithaca, N.Y.; Charles G. Myer, Minneapolis, Minn.; William W. Carson, Mendon, Mass.

[73] Assignee: Mark Holtzapple, Philadelphia, Pa.

[21] Appl. No.: 871,004

[22] Filed: Jan. 20, 1978

[51] Int. Cl.[2] ..... F15B 15/18

[52] U.S. Cl. ..... 60/459; 60/468; 64/27 R; 91/375 A; 251/120

[58] Field of Search ..... 60/494, 459, 468; 64/6, 64/8, 27 R, 27 B, 27 CS; 192/54, 56 F; 74/22 R, 23, 63, 70; 251/120, 251, 252; 91/375 A; 415/30, 39

[56] References Cited

U.S. PATENT DOCUMENTS

| | | | |
|---|---|---|---|
| 3,623,584 | 11/1971 | Hill | 192/56 F |
| 3,675,512 | 7/1972 | Hirozawa | 192/56 F |
| 3,680,673 | 8/1972 | Webb | 192/54 X |
| 3,930,554 | 1/1976 | Ward | 91/375 A X |

*Primary Examiner*—Edgar W. Geoghegan
*Attorney, Agent, or Firm*—Cushman, Darby & Cushman

[57] ABSTRACT

A torque responsive apparatus for controlling a fluid actuated control device includes a first shaft connected to a drive motor and a second shaft connected to the first shaft through a coupling device that controls fluid pressure in a hydraulic control system whereby torque delivered to the coupling device effects shifting of the coupling member to vary the size of an opening through which a control fluid is being passed whereby a change in fluid pressure will result which is proportional to the torque of the first shaft.

9 Claims, 5 Drawing Figures

TORQUE MONITOR

BACKGROUND AND BRIEF DESCRIPTION OF THE INVENTION

The present invention relates to a torque responsive control device for providing a fluid control that is proportional to the torque output of a primary mover such as a motor.

In the field of the present invention, it is known to provide a continuous pressure monitor for a fluid that is being employed in a hydraulic system for controlling the operation of a machine element. For example, hydraulic systems responsive to torque are known which vary the position of blade elements in turbines or the like. In addition, a number of devices are known which measure the torque in a shaft which may either be rotating or static and which are used to control elements such as the pitch angles of propellers in ships, planes, or other devices. However, these devices are generally complex in terms of their structure and operation and thus are costly to manufacture and install in such equipment. Also, it has been the practice to manufacture and design torque monitoring devices for relatively specific applications thereby rendering many of the devices of the prior art useful in only such specific environments.

The torque monitoring device of the present invention has for its principal object the provision of a substantially less complex yet highly reliable apparatus that can be easily incorporated into a number of motor drive systems and yet will be substantially less expensive to manufacture than the previously known devices in this field.

In a preferred embodiment, the apparatus includes a drive shaft which may be directly coupled to the output of a primary motive source, a driven shaft and a coupling means for transmitting torque from the drive shaft to the driven shaft. The coupling means is mounted in a cylindrical housing through which fluid is pumped and the characteristics of which are to be controlled. To this end, the coupling means is slidingly mounted in the housing on one end of the driven shaft and includes a torque responsive means engaged with the drive shaft so that, as the drive shaft rotates, the torque responsive means will cause movement of the coupling means to vary a characteristic of the fluid being pumped through the housing. In a preferred embodiment, the coupling means is employed to control an opening through which the fluid passes so that as the torque of the drive shaft increases, the pressure of the fluid will vary in response to movement of the coupling means. The increase or decrease in pressure, whichever is more convenient to employ, is then utilized in an hydraulic control system to effect the desired mechanical movement. As one example, the variation in the fluid pressure may be employed to control a continuously variable transmission in an automotive vehicle whereby the torque transmitted to the drive wheels of the vehicle can be maintained at an ideal ratio to the torque output of the motor to result in a conservation of fuel.

The foregoing and other advantages of the present invention will become apparent as consideration is given to the following detailed description taken in conjunction with the accompanying drawings, in which:

DETAILED DESCRIPTION OF THE INVENTION

Figure 1:
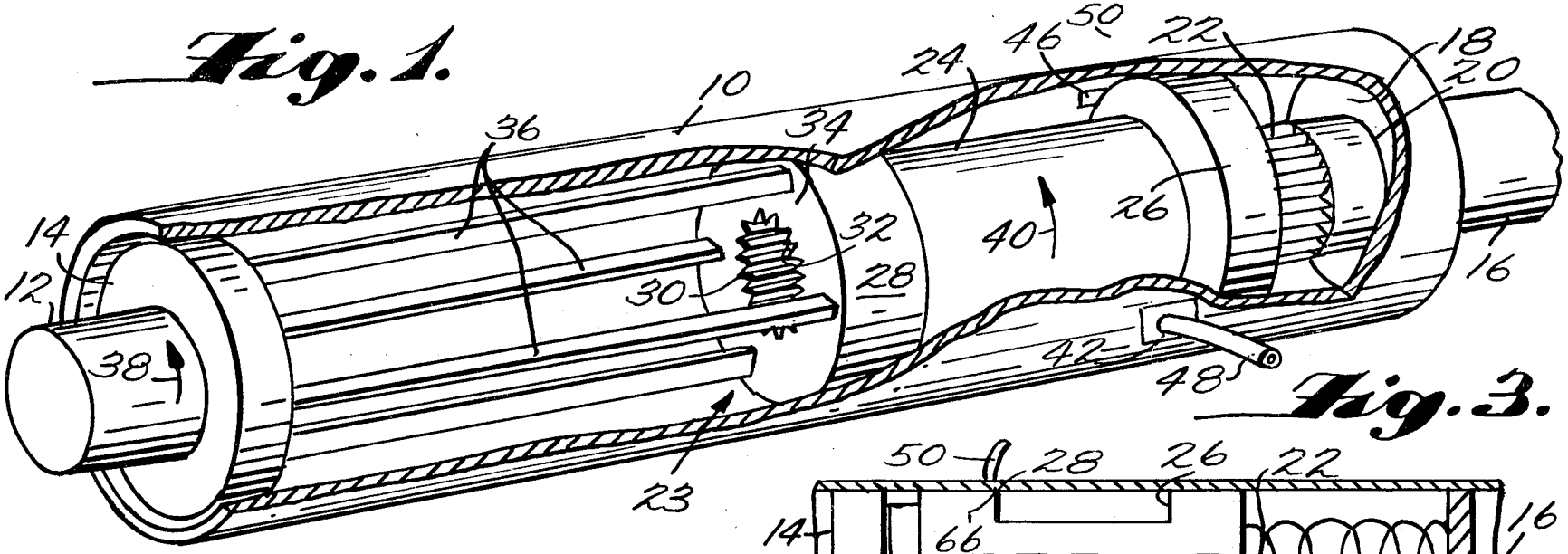
FIG. 1 is a perspective view with parts broken away of one embodiment of the apparatus of the present invention.

Referring now to the drawings, there is shown in FIG. 1, one embodiment of the present invention which includes a cylindrical housing 10 having at one end thereof a drive shaft 12 with its enlarged end 14 rotatably mounted therein. Housing 10 will, of course, be suitably fixed in position adjacent a primary power source such as a motor (not shown) so that drive shaft 12 can be suitably coupled to the main rotary output of the motor 51 (FIG. 5), the torque of which is to be monitored. The other end of housing 10 has a sealing wall 18 having an opening 20 which may be provided with bearing surfaces for accommodating a driven shaft 16 which extends through the opening 20 and into the interior of housing 10. One end of shaft 16 is formed with splines 22 while the other end (not shown) will be connected to a load such as, e.g., a differential gear for the drive wheels of a vehicle.

Housing 10, as illustrated, is generally cylindrical in shape and the axes of rotation of drive shaft 12 and driven shaft 16 coincide with the longitudinal axis of the housing 10.

Disposed within housing 10 is the coupling means 23 which includes a sleeve member 24 having at its opposite ends shoulders 26 and 28. Relative to the interior diameter of the housing 10, the portion of sleeve member 24 that extends between shoulders 26 and 28 is of reduced diameter while the exterior peripheries of the shoulders 26 and 28 are in fluid-tight sealing contact with the interior wall of the housing 10 but are slidable with respect thereto.

Sleeve member 24 is provided with an axial bore 30 which is formed with axially extending splines 32 whereby the sleeve member 24 is slidable axially on the splines 22 of driven shaft 16 but is always rotatable therewith.

The coupling means 23 further includes resiliently deformable members extending between the end 34 of sleeve member 24 and end 14. In one embodiment, these members may take the form of flat bar springs, some of which are indicated at 36. Each of the bar springs has one end fixed in end 34 and with the other ends thereof fixed in the enlarged end 14 of drive shaft 12.

With the apparatus as thus far described, it will be apparent to those skilled in the art that as drive shaft 12 is rotated in the direction of arrow 38, torque will be transmitted through the bar springs to the sleeve member 24 causing rotation thereof in the direction of arrow 40, while the spline connection between sleeve member 24 and driven shaft 16 will effect transmission of torque to drive shaft 16. As an increment of load torque is applied to shaft 16, it will momentarily rotate more slowly than shaft 12. The relative motion of shaft 12 to sleeve member 24 results in mechanical deformation of bar springs 36. The bar springs deform to such a point as the bending moment of the bar springs balances the load torque thus causing sleeve member 24 to rotate at the same speed as shaft 12. The bar spring deformation results in an axial movement of sleeve member 24 from its de-actuated position towards an actuated position which corresponds to an axial movement of the sleeve member toward end 14 parallel to the axis of the housing 10 along splines 22 which serve to guide and stabilize rotation of the sleeve member 24. According to the present invention, this movement of the sleeve member 24 is utilized to control a fluid system which will now be described.

Housing 10 is provided with a first fluid opening 42 in the wall thereof in such a position relative to the shoulders 26 and 28 that opening 42 will be obstructed by shoulder 26 as drive shaft 12 is rotated and sleeve 24 is shifted. A second fluid opening 46 which is preferably in the form of a longitudinal slot has one end thereof disposed adjacent to the shoulder 26 so that, again, longitudinal movement of the sleeve member 24 towards the drive shaft 12 will result in a restriction of the size of the opening 46.

In the present embodiment, fluid is pumped through a conduit 48 into the chamber defined by the sleeve member 24 and its two shoulders 26 and 28 and, with the sleeve member 24 in its de-actuated position, fluid will pass out of the housing through the second fluid opening 46 to other elements of the fluid control system through conduit 50, later to be described. As sleeve member 24 is moved to the left as viewed in FIG. 1 as a result of deformation of the bar springs 36 which is in direct response to torque imparted thereto by rotation of drive shaft 12, shoulder 26 of sleeve member 24 will move slightly to restrict the size of openings 42 and 46 thus resulting in a pressure rise in conduit 48 which is proportional to the torque imparted by the drive shaft 12.

As will be apparent to those skilled in this art, the ratio of torque to pressure change will be modified by a determinable constant such as the spring constant of the bar springs 36, the viscosity of the fluid, the shape of fluid openings 42 and 46 and similar factors which can be readily determined for any system.

As explained above, in the embodiment of FIG. 1, torque imparted by the drive shaft 12 results in movement of the sleeve member 24 towards the drive shaft 12 as a result of bending of the bar springs 36. However, in certain applications as may be dictated by the rotational speed of the drive shaft, other coupling means may be employed such as are illustrated in FIGS. 2 and 3.

Figure 2:
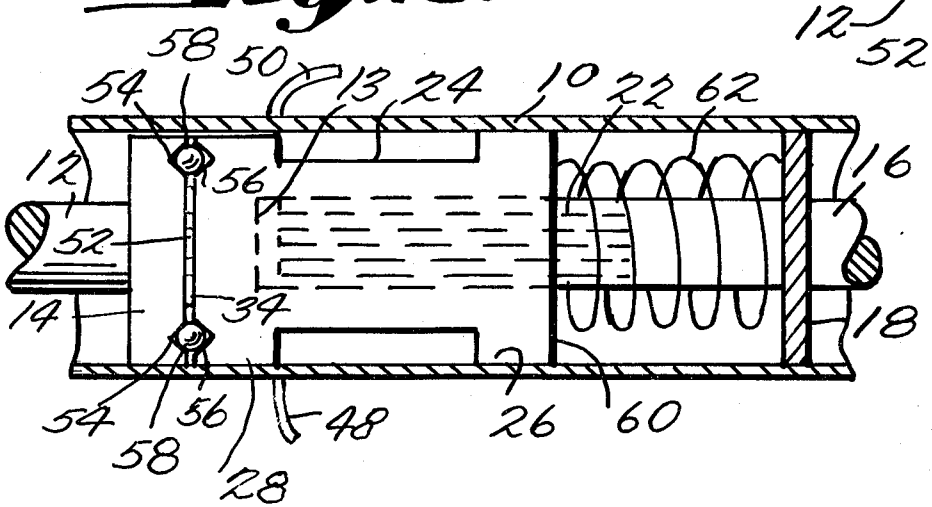
FIG. 2 is a schematic illustration of another embodiment of the apparatus of the present invention.

Referring now to FIG. 2, it will be seen that shaft 12 extends into the housing 10 so that the enlarged end 14 is immediately adjacent the face 34 of sleeve member 24. The end face 34 of sleeve member 24 is closed as the bore 30 is shortened in its axial length. The opposing face 52 of the enlarged end 14 is provided with a plurality of conical recesses 54 arranged concentrically with respect to the axis of shaft 12. The face 34 of sleeve member 24 is provided with similarly shaped and located recesses 56. It will be understood that each of the conical recesses in face 34 is alignable with a recess in face 52 to accommodate ball bearings such as those shown at 58 between each opposed pair of conical recesses. The opposite face 60 of sleeve member 24 has seated thereon spring means in the form of a coil spring 62 which acts between end wall 18 and the face 60 of sleeve member 24 to constantly urge the sleeve member towards the face 52 of shaft 12. As an increment of load torque is applied to shaft 16, it will momentarily rotate more slowly than shaft 12. The relative motion of face 34 to 52 causes the ball bearings to ride up out of their conical recesses, thus separating face 34 from 52. This separation causes axial sliding of sleeve member 24 and compression of coil spring 62. The faces will cease separating when the component of the spring compression force as transferred through the ball bearings exactly balances the load torque or, in the case of excessive loading, when the end of the splined shaft 22 contacts the interior face 13 of sleeve member 24. The spring should rotate with shaft 16 as by fixing wall 18 on shaft 16 and providing sealing means between the periphery of wall 18 and the inner surface of housing 10.

In this embodiment, instead of openings 42 and 46 being located adjacent shoulder 26, they are located adjacent shoulder 28 since torque imparted to the sleeve member through the ball bearings will result in an axial shift of the sleeve member 24 rightwardly as viewed in FIG. 2 against the force of spring 62 to effect the restriction of the openings 42 and 46 adjacent shoulder 28 and the resultant pressure increase in conduit 48.

Figure 3:
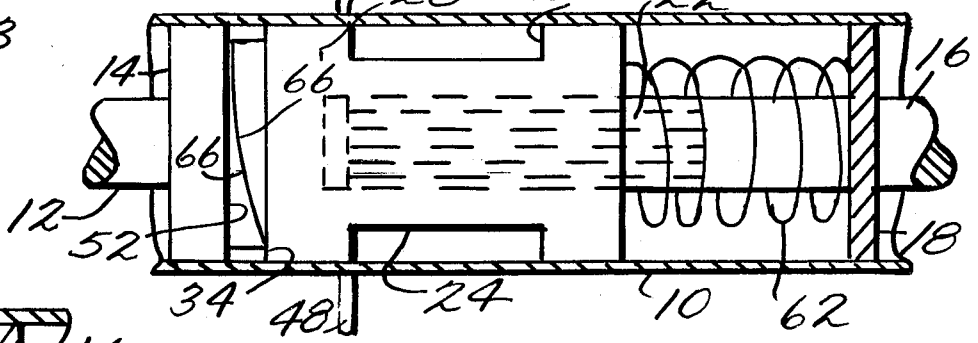
FIGS. 3 and 4 are illustrations of a third embodiment of the apparatus of this invention.
Figure 4:
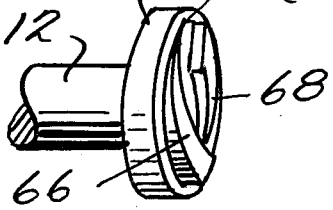

Referring now to FIGS. 3 and 4, there is shown another arrangement similar to that of FIG. 2 but where helical surfaces are provided between the faces 52 and 34 of the enlarged end 14 and sleeve member 24, respectively. In this arrangement, as more clearly shown in FIG. 4, a pair of helical surfaces 66 and 68 are provided on the face 52 of enlarged end 14 of shaft 12 while a similar pair of helical surfaces are provided on the face 34 of sleeve member 24 as shown at 66' in FIG. 3. With this arrangement, the helical spring 62, the spring constant of which is known and selected relative to the range of power output of the primary motive source, forces the sleeve member 24 to the left as viewed in FIG. 3 to maintain the helical surfaces in engagement. As an increment of load torque is applied to shaft 16, it will momentarily rotate more slowly than shaft 12. The relative rotational movement of helical faces 66 to 66' will cause axial sliding of sleeve member 24 away from enlarged end 14 and therefore compression of coil spring 62. Separation will cease when the component of the spring compression force as transferred through the helical faces exactly balances the load torque.

Use of the torque responsive apparatus of the present invention will now be explained in conjunction with FIG. 5.

Figure 5:
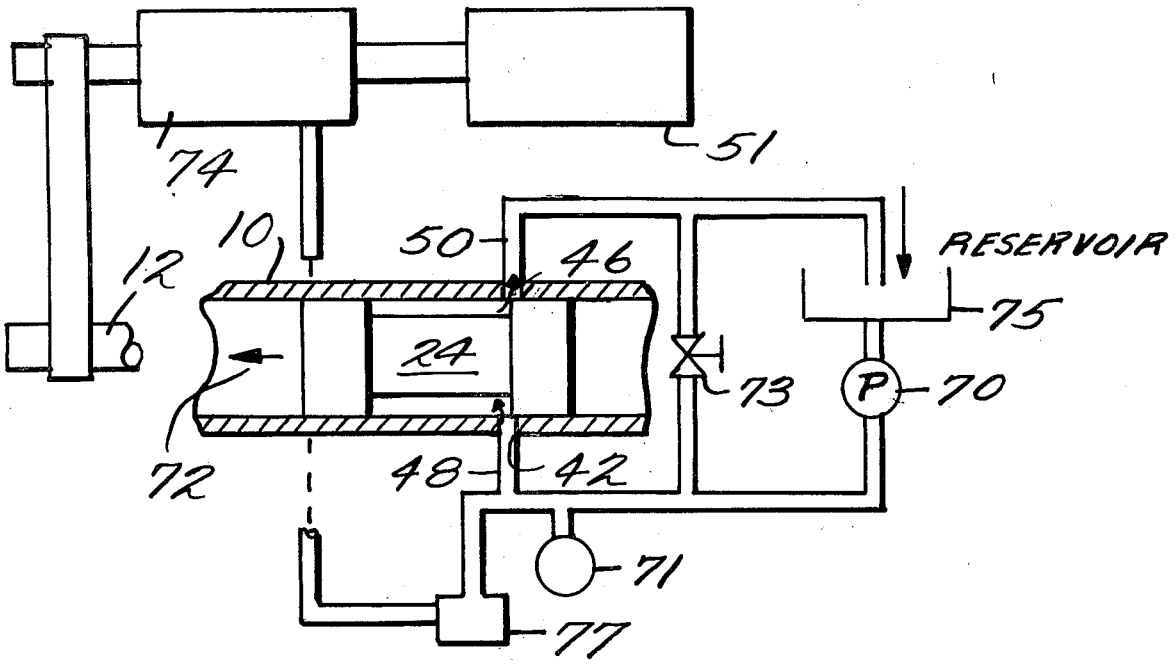
FIG. 5 is a schematic illustration of a fluid control system that can be employed with the apparatus of this invention.

In FIG. 5, it will be seen that the hydraulic system consists of: conduits 48 and 50, by-pass valve 73, reservoir 75 to replace any fluid lost to leakage, a constant volume pump 70, a pressure gauge 71 to indicate the pressure pump 70 must supply to overcome resistance of the constant volume flow through openings 42 and 46 and by-pass valve 73, and a connection 77 to the device which is to be controlled by this hydraulic arrangement such as the continuously variable transmission 74. By-pass valve 73 offers manual adjustment of the pressure in line 48 and protection for the pump in case opening 46 is completely closed.

If the embodiment of FIG. 1 is utilized, increased torque causes leftward movement of sleeve member 24, a closing of openings 42 and 46, and an increase of pressure in line 48. Thus, pressure is directly proportional to torque. An inverse proportionality of pressure to torque may be established by placing openings 42 and 46 next to shoulder 28 rather than next to shoulder 26. If the embodiments of FIGS. 2 and 3 are utilized, these pressure torque relationships just described will be exactly reversed as an increase in torque causes a rightward movement of sleeve member 24 rather than a leftward movement.

The pressure in line 48 may be used to control a device such as pollution control equipment requiring torque information or a continuously variable transmission. With such an arrangement, as illustrated in FIG. 5, using the arrangement of FIG. 1, with relatively stiff bar springs 36, even small variations in the torque of drive shaft 12 will result in a pressure rise in line 48 of sufficient magnitude to closely control a hydraulic control element such as a spring biased piston and cylinder arrangement. Thus, the output of a primary motor source such as an automobile vehicle motor can be utilized close to its maximum efficiency with a continuously variable transmission when properly adjusted to obtain maximum fuel consumption efficiency for a given engine output.

Having described the invention, it will be apparent that various modifications may be made therein without departing from the spirit and scope of the invention as defined in the appended claims.

What is claimed is:

1. A fluid control apparatus comprising a drive means, a driven means, coupling means for transmitting torque from said drive means to said driven means, a housing for said coupling means, means for supplying fluid to said housing and means for passing fluid from said housing, said coupling means being movable in said housing between an actuated and a de-actuated position in response to said drive means delivering torque through said coupling means to said driven means, said means for supplying fluid and said means for passing fluid being fixed relative to said housing so that said coupling means is movable relative to said means for supplying fluid and said means for passing fluid, said coupling means including means for controlling the passage of fluid through said housing as said coupling means is moved between said actuated and de-actuated positions, said means for controlling including a shoulder member carried by said coupling means and movable therewith to block at least one of said means for supplying fluid and means for passing fluid.

2. A fluid control apparatus comprising a drive means, a driven means, coupling means for transmitting torque from said drive means to said driven means, a housing for said coupling means, means for supplying fluid to said housing and means for passing fluid from said housing, said coupling means being movable in said housing between an actuated and a de-actuated position in response to said drive means delivering torque through said coupling means to said driven means, said coupling means including means for controlling the passage of fluid through said housing as said coupling means is moved between said actuated and de-actuated positions to vary the pressure of said fluid at a point upstream of said housing in said means for supplying fluid to said housing, said drive means comprising a shaft connected through variable transmission means to a motor, said transmission means being controlled by the pressure of the fluid passing through said housing.

3. A fluid control apparatus comprising a drive means, a driven means, coupling means for transmitting torque from said drive means to said driven means, a housing for said coupling means, means for supplying fluid to said housing and means for passing fluid from said housing, said coupling means being movable in said housing between an actuated and a de-actuated position in response to said drive means delivering torque through said coupling means to said driven means, said coupling means including means for controlling the passage of fluid through said housing as said coupling means is moved between said actuated and de-actuated positions, said drive means including a first rotatable shaft having one end, said driven means comprising a second rotatable shaft having one end located in said housing and said coupling means including a sleeve member slidably mounted in said housing on said one end of said second shaft, said sleeve member having said means for controlling the passage of fluid through said housing.

4. The apparatus as claimed in claim 3 wherein said coupling means includes a resiliently deformable member connecting said one end of said first shaft to said sleeve member so that, as said first shaft rotates in a given direction, deformation of said resiliently deformable member will result and will effect movement of said sleeve member from said de-actuated position to said actuated position in proportion to the torque of said first shaft.

5. The apparatus as claimed in claim 4 wherein said means for supplying fluid to said housing and means for passing fluid from said housing includes a first and a second opening, respectively, spaced apart in said housing with each said opening connected to a conduit of a fluid supply system, said means for controlling the passage of fluid through said housing comprising a shoulder portion on said sleeve member disposed to pass over at least one of said openings to thereby restrict the passage of fluid therethrough and hence through said housing.

6. The apparatus as claimed in claim 5 wherein said housing is a cylinder having opposite ends, an interior wall extending therebetween and a longitudinal axis, said sleeve member being disposed in said cylinder and having spaced apart shoulder portions each in fluid sealing and sliding contact with said interior wall thereof so as to define a fluid chamber therebetween, said sleeve member being movable, with said shoulder portions in sliding contact with said interior wall, along said longitudinal axis.

7. The apparatus as claimed in claim 3, wherein said housing includes spring means for constantly urging said sleeve member toward said one end of said first shaft and said coupling means includes torque responsive means acting between said one end of said first shaft and said sleeve member for moving said sleeve member against the urging of said spring means as said first shaft transmits torque to said sleeve member.

8. The apparatus as claimed in claim 7 wherein said torque responsive means includes a plurality of conical cavities in the end of said first shaft and the opposing face of said sleeve member with ball bearings being disposed between each pair of cavities.

9. The apparatus as claimed in claim 7 wherein said torque responsive means includes opposing helical surfaces on said one end of said first shaft and the opposing face of said sleeve member.

* * * * *